United States Patent [19]

Karius

[11] 4,438,374

[45] Mar. 20, 1984

[54] CONTROL OF ELECTRIC DISCHARGE LAMPS FOR SCANNING PURPOSES

[75] Inventor: Helmut Karius, Schönkirchen, Fed. Rep. of Germany

[73] Assignee: Dr.-Ing. Rudolf Hell G.m.b.H., Kiel, Fed. Rep. of Germany

[21] Appl. No.: 403,512

[22] PCT Filed: Nov. 22, 1980

[86] PCT No.: PCT/DE80/00174

§ 371 Date: Jul. 13, 1982

§ 102(e) Date: Jul. 13, 1982

[87] PCT Pub. No.: WO82/01802

PCT Pub. Date: May 27, 1982

[51] Int. Cl.[3] ..... H05B 41/16

[52] U.S. Cl. ..... 315/362; 315/307; 315/360; 315/DIG. 5

[58] Field of Search ..... 315/200 R, 205, 208, 315/307, 360, 362, DIG. 5

[56] References Cited

U.S. PATENT DOCUMENTS

| | | | |
|---|---|---|---|
| 3,198,982 | 8/1965 | Benson et al. | 315/362 X |
| 4,100,462 | 7/1978 | McLellan | 315/362 X |
| 4,327,309 | 4/1982 | Wallot | 315/362 X |
| 4,337,418 | 6/1982 | Walz | 315/362 |

*Primary Examiner*—Eugene R. LaRoche

*Attorney, Agent, or Firm*—Brisebois & Kruger

[57] ABSTRACT

The invention relates to methods and apparatus for prevention of cataphoresis effects in the case of electric discharge lamps operated on direct current, which serve the purpose of illuminating the originals which are to be scanned in picture transmission apparatus. Cataphoresis results in the anode-side darkening of such lamps after a certain period of operation and thereby in non-uniform illumination of the original. The effect of the invention is that the lamp is operated evenly in both polarities throughout its service life, that a polarity reversal is performed before non-uniform illumination is caused by cataphoresis and that a polarity reversal never occurs during a picture transmission.

4 Claims, 2 Drawing Figures

CONTROL OF ELECTRIC DISCHARGE LAMPS FOR SCANNING PURPOSES

DESCRIPTION

1. Technical Sphere

The invention relates to the technology of picture transmission, in particular to the scanning of originals under utilisation of electric discharge lamps operated by direct current.

2. Fundamental State of Technology

The line by line illumination of the original for scanning purposes is frequently undertaken with fluorescent tubes in picture transmission instruments, copying appliances, telecopiers, reading apparatus, etc. These lamps are preferably operated with direct current to prevent undesirable alternating light modulation.

The charge of these lamps consists of a heavy gas, being mercury vapour as a rule which, upon being energised by the discharge, transmits radiation preponderantly in the ultra-violet range. For its part, this strikes a coating applied on the internal surface of the electric discharge tube, which has the property of radiating light in the visible range. In the case of direct current operation a stage is then reached after a particular period of operation of a fluorescent tube of this kind, when a mercury impoverishment occurs in the vicinity of the anode, because the mercury atoms ionised by collision ionisation are displaced towards the cathode by so-called cataphoresis and accumulate at the same. The result is that the number of non-energised mercury atoms in the vicinity of the anode, and thereby the probability of an ionisation by impact, also become lower. Consequently, the UV radiation generated and thereby too the excitation of the fluorescent substance, are reduced thereat. The tube gets darker at the anode extremity and can no longer fulfil the requirement for uniform illumination of an image line for scanning purposes. The action described depends on time and occurs rather suddenly after a few hours of operation at constant lighting density.

It has been known for a long time, and is also recommended by the lamp manufacturers, to counter this action by alternation of the polarity (e.g. described in "Leuchstofflampen und ihre Anwendung", [Fluorescent lamps and their application], Dr. W. Elenbaas, Philips technische Bibliothek, 1962, pages 111 and 162).

Polarity reversal circuits which are actuated manually by the operative after a definite period are inappropriate for image scanning apparatus because their operation is frequently forgotten. An uncomplicated polarity reversal by means of a time switch is also unusable for image scanning because the probability that this switching action would occur in the middle of a transmission, is too great. The transmission would be disturbed because the lamp is wholly quenched—even if but briefly—during a polarity reversal, as a matter of fact.

Even if the lamp were to have its polarity reversed before every transmission, as a matter of principle, there would be no guarantee that the total service life of the lamp would be split evenly between the two polarities because the number of transmissions during the service life is not too large and the transmission periods in question fluctuate considerably. One polarity is thereby given preference all too easily, and the phenomena described above intervene.

SUMMARY OF THE INVENTION

The invention is based on the task of specifying a circuit which automatically undertakes a polarity reversal before the distribution of lighting density along the tube is rendered irregular by cataphoresis, which assures that the polarity reversal never occurs during a current transmission and which thus makes provision that the lamp is operated evenly in both polarities regarded throughout its service life.

The invention accomplishes this by the fact that the lamp incandescence period during an initial picture transmission in a first polarity is measured and stored, that the polarity is reversed before the start of a second picture transmission, that the lamp incandescence period in the second polarity is equally measured and stored, that the difference between the first and second incandescence periods is calculated and stored, and that a balance of the total incandescence period is carried forward in this manner for all subsequent transmissions under consideration of the polarity which, compared to the incandescence period of the last transmission, repolarises the lamp voltage before the following transmission only if the last period of incandescence had been longer than the balance stored.

Systems for implementation of the method are specified in the subsidiary claims.

BRIEF DESCRIPTION OF THE DRAWINGS

The invention is described in particular in the following with reference to FIGS. 1 and 2.

In these.

THE BEST WAY FOR EMBODYING THE INVENTION

Figure 1:
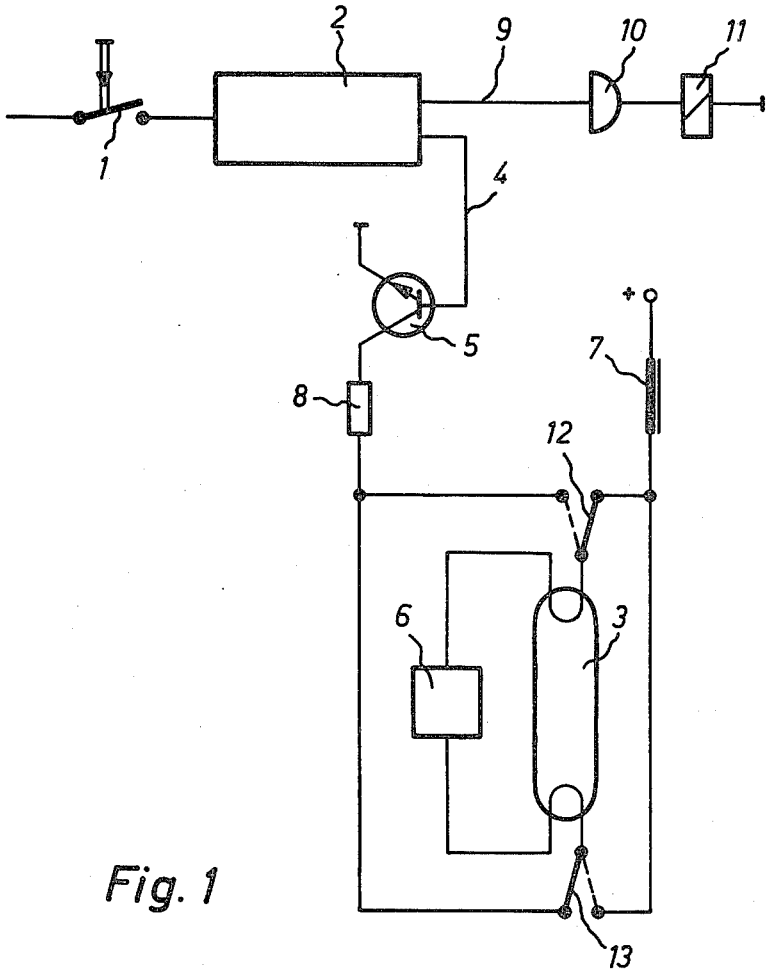
FIG. 1 shows the fundamental circuit.

Let it be assumed that the apparatus is switched on and ready for operation for a transmission. Upon actuating the start key 1, a microcomputer 2 (e.g. Intel 8748) causes the start of the transmission. Apart from perceptible control of the sequence of operations, activation of the scanning electronic system, etc., the microcomputer also causes the striking of the fluorescent lamp 3 which serves the purpose of line by line illumination during the opto-electronic scanning operation.

The fluorescent lamp 3 is switched on via a transistor 5 by means of a corresponding output signal of the microcomputer 2 at the output terminal 4. The fluorescent lamp 3 is operated with direct current for the reasons referred to above.

The ignition occurs in the usual manner by means of a starter 6 and of a preconnected choke 7.

A current limiting resistor 8 is inserted into the circuit because the choke 7 cannot operate as a sufficiently great series resistance in the case of direct current operation.

Figure 2:
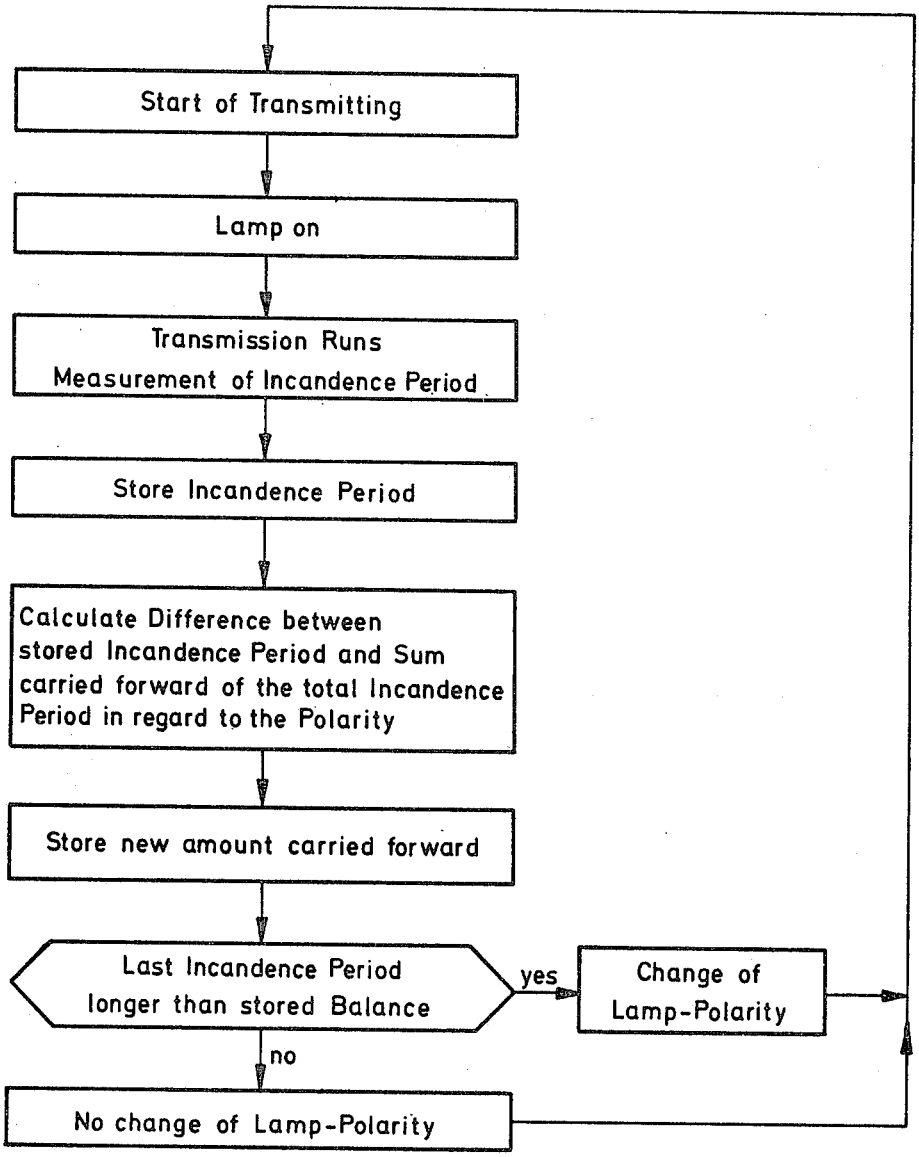
FIG. 2 shows the sequence diagram.

The sequence diagram according to FIG. 2 elucidates the functional steps of the microcomputer 2. Upon initial actuation of the starting key 1, the lamp 3 is ignited, and a counting operation begins in the microcomputer 2, which is stopped upon termination of the transmission. The counter reading is then a measure for the period of incandescence of the lamp 3 and is stored in the microcomputer 2.

A counting operation is started again upon actuating the starting key 1 for the next transmission and after reversal of polarity of the operating voltage of the lamp 3, which is stopped upon termination of this transmission and is equally stored. The microcomputer 2 thereupon performs a subtraction and stores the quantity determined for the difference between the incandescence periods of the two scanning operations.

Upon starting another and third transmission, the counting operation begins again and is stopped together with this transmission. The microcomputer 2 thereupon compares this last period of incandescence to the difference stored and thereby derives a criterion regarding whether or not the polarity reversing relay 11 is energised via the output terminal 9 and the exciter 10. The polarity reversing relay always reverses the polarity of the lamp voltage when the last period of incandescence had been longer than the stored difference between the periods of incandescence of the previous scanning operations. These actions evolve analogously during all subsequent transmissions the last incandescene period always being compared to the stored carry-over of the existing total incandescence period under consideration of the polarity. The polarity reversal is operated by means of the relay contactors 12 and 13. Although the transmission periods may be very different, an even division of the two polarities throughout the service life of the lamp occurs as a result in this manner, and thereby an extension of the lamp service life under the operating conditions specified.

A corresponding circuit may easily also be assembled with conventional counting and storage "building blocks", but the application of microcomputers may now already be considered as part of the state of technology.

I claim:

1. A method for prevention of cataphoresis actions in the case of electric discharge lamps operated by direct current, in particular during their utilisation in picture transmission apparatus with nonpunctiform illumination of the original portions which are to be scanned, characterised in that the lamp incandescence period is measured in a first polarity during a first picture transmission and is stored, that the polarity is reversed before beginning a second picture transmission, that the lamp incandescence period in the second polarity is equally measured and stored, that the difference between the first and second incandescence periods is established and stored, and that a balance quantity of the total incandescence period is established in this manner during all subsequent transmissions under consideration of the polarity which, being compared to the incandescence period of the last transmission, reverses the polarity of the lamp voltage before the following transmission only if the last incandescence period had been longer than the carry-over stored.

2. An apparatus for implementation of the method according to claim 1, characterised by means of counting and storing the incandescence period during a first and a second transmission, means which establish and store the difference between these incandescence periods, means of counting the incandescence period during another and third transmission, means of establishing and storing the difference between the last incandescence periods and the established balance of the total incandescence period, under consideration of the polarity, means of reversing the polarity of the lamp operating voltage and means which have the effect that the lamp operating voltage has its polarity reversed after the last picture transmission only if the lamp incandesce period during this picture transmission was longer than the balance established and stored.

3. An apparatus for implementation of the method according to claim 1, in which which the separate process steps are performed by means of a microcomputer.

4. An apparatus for implementation of the method according to claim 1, in which the separate process steps are performed by means of conventional counting, switching and storage stages.

* * * * *